US008978281B2

(12) United States Patent
Tanaka

(10) Patent No.: US 8,978,281 B2
(45) Date of Patent: Mar. 17, 2015

(54) DISPLAY MEMBER USED BY BEING ATTACHED ON WINDOW PANE, ETC

(71) Applicant: Nam Corporation, Osaka (JP)

(72) Inventor: Nobuyoshi Tanaka, Osaka (JP)

(73) Assignee: Nam Corporation, Osaka (JP)

( * ) Notice: Subject to any disclaimer, the term of this patent is extended or adjusted under 35 U.S.C. 154(b) by 0 days.

(21) Appl. No.: 14/180,716

(22) Filed: Feb. 14, 2014

(65) Prior Publication Data

US 2014/0237874 A1 Aug. 28, 2014

(30) Foreign Application Priority Data

Feb. 25, 2013 (JP) ..... 2013-034308
Dec. 25, 2013 (JP) ..... 2013-266393

(51) Int. Cl.
*A47G 1/06* (2006.01)

(52) U.S. Cl.
CPC ..... *A47G 1/06* (2013.01); *A47G 2001/0666* (2013.01); *A47G 2001/0672* (2013.01)
USPC ..... 40/760; 40/772

(58) Field of Classification Search
CPC ..... G09F 15/00; G09F 7/12; G09F 1/12
USPC ..... 40/594, 772, 773, 611.01, 611.05
See application file for complete search history.

(56) References Cited

U.S. PATENT DOCUMENTS 4,231,833 A * 11/1980 Lieberman ..... 156/249
4,914,842 A * 4/1990 Lieberman ..... 40/773
4,955,153 A * 9/1990 Albrecht et al. ..... 40/661
5,353,925 A * 10/1994 Lennen et al. ..... 206/204
6,574,896 B1 * 6/2003 Howell ..... 40/737

FOREIGN PATENT DOCUMENTS

FR 2641959 A1 * 7/1990

* cited by examiner

*Primary Examiner* — Casandra Davis
(74) *Attorney, Agent, or Firm* — Wenderoth, Lind & Ponack, L.L.P.

(57) ABSTRACT

A display member includes a frame member formed of heat insulation material; an adhesive layer with removable adhesion formed on one side of the frame member to be attached on a window pane; and a synthetic resin plate arranged on the other side of the frame member. The synthetic resin plate is removably provided on the frame member, thereby to form a housing for a printed material in a space defined by the synthetic resin, the frame member, and the window pane.

1 Claim, 2 Drawing Sheets

DISPLAY MEMBER USED BY BEING ATTACHED ON WINDOW PANE, ETC

TECHNICAL FIELD

The present invention relates to a display member used by being attached on a window pane etc.

BACKGROUND ART

Conventionally, where a printed material such as a picture, a poster and the like (in the description hereinafter referred to merely as a "printed material") is displayed on a window pane toward inside or outside of a room, an adhesion tape or a sticky tape is usually used to directly stick the printed material on the window pane.

However, there are problems in this display method such as the printed material cannot be displayed beautifully because the adhesion tape or sticky tape stands out, replacement of printed materials is troublesome, the printed material may be damaged by dew condensation etc., or the printed material is hardly removed due to its adhesion to the window pane.

SUMMARY OF INVENTION

The present invention is made in view of the problems of the conventional way of display as described above, and an object of the present invention is to provide a display member used by being attached on a window pane etc. that is capable of displaying a printed material beautifully, enables easy replacement of printed materials to be displayed, and further, prevents the printed material from being damaged by dew condensation etc., or prevents adhesion of the printed material that is hardly removed from the window pane.

Means for Solving the Problems

To achieve the above object, the display member used by being attached on a window pane etc. of the present invention comprises a frame member formed of heat insulation material; an adhesive layer with removable adhesion formed on one side of the frame member that is to be attached on a window pane etc.; and a synthetic resin plate arranged on the other side of the frame member. The synthetic resin plate is removably provided on the frame member thereby to form a housing for a printed material in a space defined by the synthetic resin plate, the frame member and the window pane etc.

Here, the term "a window pane etc." includes, in addition to a window pane, a member that has a display surface to display a printed material, for example a wall and the like.

Also, the term "a synthetic resin plate" includes a sheet or film as well as a board, and the term "removable adhesion" includes removable stickiness and removable adsorption.

In this case, an intermediate synthetic resin plate for separating the space may be placed at an intermediate position in the thickness direction of the frame member.

Also, an inner size of the frame member may be formed in accordance with any size defined by ISO 216.

Advantages of the Invention

According to the display member of the present invention to be used by being attached on a window pane etc., by inserting a printed material in a housing for a printed material formed in a space defined by a synthetic resin plate, a frame member and a window pane etc., the printed material can be displayed beautifully, and by removing the synthetic resin plate from the frame member, printed materials to be displayed can be replaced easily. In addition, since the housing for a printed material is an insulated and closed space, damage to the printed material due to dew condensation etc. or adhesion of the printed material that is hardly removed from the window pane can be prevented.

In addition, since the housing for a printed material is an insulated and closed space, heat insulating property of a portion of a window pane etc. that is covered by this display member is enhanced so that heating effect or cooling effect of a room can be enhanced, and dew condensation can be prevented.

In addition, by placing an intermediate synthetic resin plate for separating the space at an intermediate position in the thickness direction of the frame member, a space separated by the intermediate synthetic resin plate is formed, which becomes the housing for a printed material or an insulated space, so that insulation and closing property of the housing for a printed material can be further enhanced.

Further, by forming an inner size of the frame member in accordance with any size defined by ISO 216, a printed material with a size of ISO 216 can be neatly displayed without any gap being caused.

BRIEF DESCRIPTION OF DRAWINGS

FIGS. 1A and 1B show an embodiment of a display member used by being attached on a window pane etc. according to the present invention, in which FIG. 1A is a perspective view showing a condition of the display member being attached on a window pane and FIG. 1B is a cross sectional view showing the same condition.

DETAILED DESCRIPTION OF PREFERRED EMBODIMENTS

Concrete embodiments of the display member used by being attached on a window pane etc. of the present invention will be demonstrated hereinafter with reference to the accompanying drawings.

Figure 1A:
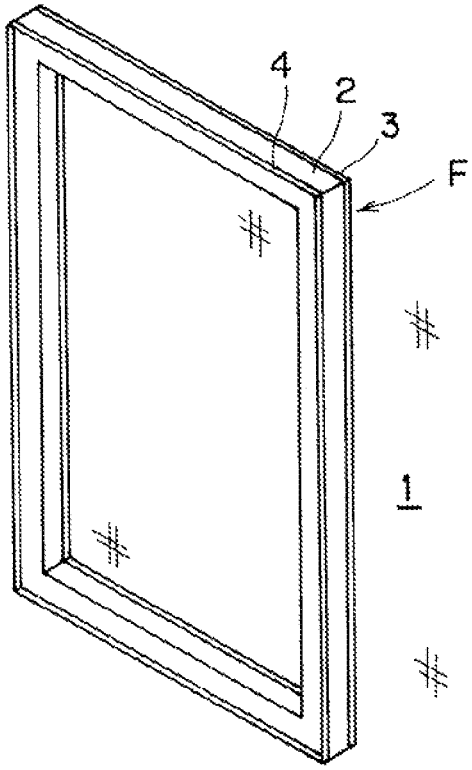
Figure 1B:
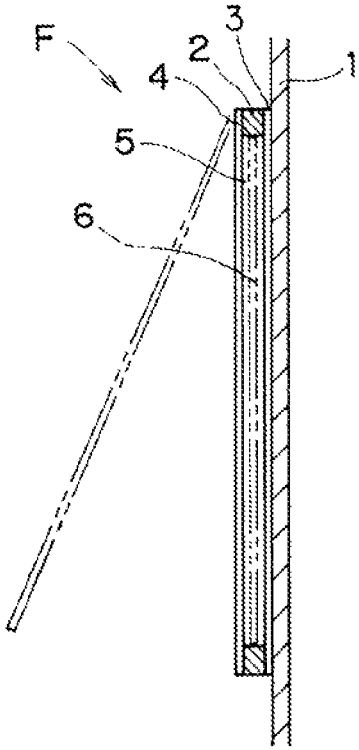

FIG. 1 shows an embodiment of the display member of the present invention used by being attached on a window pane etc.

The display member F is used by being attached on a window pane 1, and comprises a frame member 2 formed of heat insulation material; an adhesive layer 3 with removable adhesion formed on one side of the frame member to be attached on the window pane 1; and a synthetic resin plate 4 arranged on the other side of the frame member. The synthetic resin plate 4 is removably provided on the frame member 2 thereby to form a housing 5 for a printed material in a space defined by the synthetic resin plate 4, the frame member 2 and the window pane 1.

The frame member 2 formed of heat insulation material in this embodiment may be an integrally molded frame or a frame comprising a combination of belt-like members, having a width of several to several tens of millimeters, more preferably around 5 to 30 millimeters, and a thickness of 0.5 to 10 millimeters, more preferably around 1 to 5 millimeters, which is formed of a synthetic resin material such as foamed or hollow fabrication polyurethane resin, polystyrene resin, polyolefin resin and elastomer, wood or a compound material laminating such materials having heat insulating properties.

In a case where the display member F is used by being attached on a window pane 1 of a sliding window, the thickness of the entire display member F including the frame member 2 is preferably set within 5 millimeters so that opening and closing of the sliding window can be performed with no trouble.

As to color of the frame member 2, it may be any color such as white, or natural color of the material (wood) may be kept. It may be translucent or transparent as well.

The frame member 2 may be formed into any shape such as rectangle, rectangle with rounded or chamfered corners, polygon, round or oval shape. In addition, in order to provide the frame member 2 with high designability, it may have, for example, an outer edge with patters etc. as necessary.

In this case, by forming an inner size of the frame member 2 in accordance with any size defined by ISO216 (i.e., . . . A4, A5, A6, . . . B4, B5, B6, . . . ), the printed material 6 with a size of ISO 216 (i.e., paper sizes with an aspect ratio of $1:\sqrt{2}$) can be neatly displayed without any gap being caused.

In this embodiment, the frame member 2 is formed into such that the housing 5 for a printed material is hollow (i.e., the frame member 2 is bottomless frame). With this arrangement, a printed material 6 can be displayed toward inside or outside of a room, or both toward inside and outside of a room as necessary.

In a case where the frame member 2 is used by being attached on the window pane 1 to display the printed material 6 toward inside of a room, the frame member 2 may be formed into a frame with a bottom having the housing 5 for a printed material.

In order to prevent the printed material 6 in the housing 5 for a printed material from moving, a back-up material (not shown) formed of the same heat insulation material as of the frame member 2 may be provided on the back of the printed material 6.

As the adhesive layer 3 with removable adhesion, an adhesive such as an acrylic-based, silicone-based or urethane-based adhesive etc. (including a sticky tape), a resin material having self-adhesiveness such as an elastomer etc. or a foamed resin sheet piece having adsorptive property may be used.

As the adhesive layer 3, a colorless and transparent one, colored one, translucent one, or non-transparent one etc. may be usable.

As the synthetic resin plate 4, a hard or soft synthetic resin board (including a sheet or a film. The same shall apply hereinafter.) that is formed of acrylic resin, polycarbonate resin, vinyl chloride resin, polyolefin resin etc. having a thickness of about 0.1 to tens of millimeters, more preferably 0.5 to 1 millimeter may be used.

Also, as the synthetic resin plate 4, in addition to a colorless and transparent one, a colored one, translucent (smoked) one, non-transparent one, the one with surface treatment such as mirror finish, or the one that has been given functional materials such as ultraviolet absorber may be used according to the printed material 6 to be displayed or according to a display direction of the printed material 6 etc.

As a means for removably fixing the synthetic resin plate 4 to the frame member 2, a method in which the synthetic resin plate 4 is removably adhered to the frame member 2 by use of an adhesive such as an acrylic-based or silicone based adhesive etc. (including a sticky tape) or a foamed resin sheet piece having adsorptive property may be suitably adopted.

In such a case, either an entire or a part of the synthetic resin plate 4 may be attached to and detached from the frame member 2 for housing the printed material 6 in the housing 5 for a printed material, or for replacement of the printed material 6. If the synthetic resin plate 4 has high rigidity, and only a part of the synthetic resin plate 4 is attached to and detached from the frame member 2, a flexible part may be formed, by making the thickness of the synthetic resin plate 4 thin for example, at a boundary portion of the part where attachment/detachment of the synthetic resin plate 4 is performed in order to facilitate attachment/detachment.

Further, it is preferable that strength of adhesive bonding between the synthetic resin plate 4 and the frame member 2 is smaller than that between the frame member 2 and the window pane 1 by the adhesive layer 3.

Regarding means for removably fixing the synthetic resin plate 4 to the frame member 2, an optional method such as a method in which attracting force of a magnet is used may be adopted in addition to the removable adhesion. More specifically, magnets (or magnetic bodies) that attract each other may be provided on a surface of the frame member 2 and a corresponding surface of the synthetic resin plate 4.

According to the display member F used by being attached on a window pane etc., by inserting the printed material 6 in the housing 5 for a printed material formed in a space defined by the synthetic resin plate 4, the frame member 2 and the window pane 1, the printed material 6 can be displayed beautifully, and replacement of the printed material 6 that is displayed becomes easier by attachment/detachment of the synthetic resin plate 4 with respect to the frame member 2. Further, since the housing 5 for a printed material becomes an insulated and closed space, it prevents the printed material 6 from being damaged by dew condensation etc. or prevents adhesion of the printed material 6 that is hardly removed from the window pane 1.

In addition, since the housing 5 for a printed material becomes an insulated and closed space, heat insulating property of a portion of the window pane 1 that is covered by the display member F is enhanced (in order to increase the area that covers the window pane 1, the display member F may be enlarged, or plurality of the display members F may be placed) so that heating effect or cooling effect of a room can be enhanced, and dew condensation can be prevented.

In the above described embodiment, the housing 5 for a printed material is an entire space defined by the synthetic resin plate 4, the frame member 2 and the window pane 1. However, like the display member used for being attached on a window pane etc. in the modified embodiment as shown in FIG. 2, an intermediate synthetic resin plate 7 for separating the space defined by the synthetic resin plate 4, the frame member 2 and the window pane 1 may be placed at an intermediate position in the thickness direction of the frame member 2, thereby to form two spaces divided by the intermediate synthetic resin plate 7 (alternatively, more than three spaces may be formed by arranging plurality of the intermediate synthetic resin plates 7 at an interval), one of which, for example a space on the room side becoming the housing 5 for a printed material, and other becoming an insulating space 8 (or vise versa).

Figure 2A:
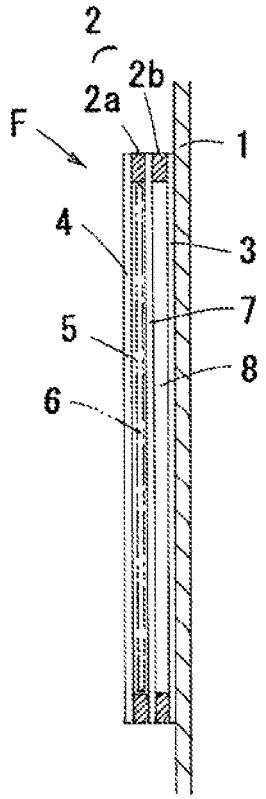
FIGS. 2A and 2B are cross sectional views of a modified embodiment of the display member used by being attached on a window pane etc. according to the present invention, showing a condition in which the display member is attached on a window pane.
Figure 2B:
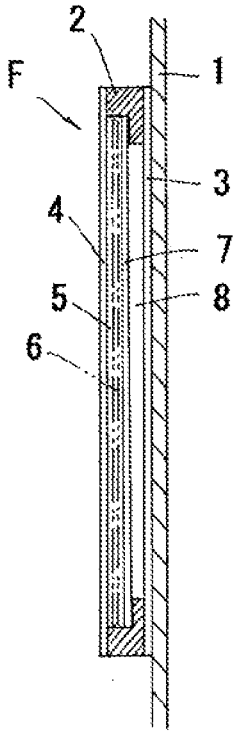

In such a case, when providing the intermediate synthetic resin plate 7, the frame member 2 can be divided into a frame member 2*a* and a frame member 2*b*, between which the intermediate synthetic resin plate 7 is placed and integrated by bonding etc. as shown in FIG. 2 (*a*), or alternatively, the frame member 2 may be provided with a stepped portion or a groove in which the intermediate synthetic resin plate 7 is fitted and integrated by bonding etc.

With this arrangement, insulation and closing property of the housing 5 for a printed material can be further enhanced.

The intermediate synthetic resin plate 7 may be of colored, smoked or non-transparent material, and further may have undergone surface treatment such as mirror finish, or may be given functional materials such as ultraviolet absorber as necessary, to provide the intermediate synthetic resin plate 7 with high designability, increase the durability of the printed material 6 being displayed, or to display the printed material 6 toward both inside and outside of a room.

The display member of the present invention used by being attached on the window pane etc. has been described based on the embodiment. However, the present invention is not limited to the arrangement in this embodiment, and it will be obvious to those skilled in the art that various changes may be made without departing from the scope of the invention. For example, an object on which the display member F is attached is not limited to a window pane but wide variety of members that have a display surface to display a printed material such as a wall etc. may by applicable.

INDUSTRIAL APPLICABILITY

Since the display member used by being attached on a window pane etc. according to the present invention is capable of displaying a printed material beautifully, enables easy replacement of printed materials to be displayed, and further, prevents the printed material from being damaged by dew condensation etc., or prevents adhesion of the printed material that is hardly removed from the window pane, it can be widely used in various applications to display a printed material on a window pane toward inside or outside of a room. It is also applicable when displaying a printed material on a wall and the like.

The invention claimed is:

1. A display member to be attached to a window pane, said display member comprising:

a frame member formed of heat insulation material;

an adhesive layer having removable adhesion, said adhesive layer being formed on a first side of said frame member to be attached to the window pane;

a main synthetic resin plate arranged on a second side of said frame member, said synthetic resin plate being removably provided on said frame member to form a housing for printed material in a space defined by said synthetic resin plate, said frame member, and the window pane; and an intermediate synthetic resin plate for dividing the space, said intermediate synthetic resin plate being located at an intermediate position in a thickness direction of said frame member.

* * * * *